US008001695B2

(12) United States Patent
Watters

(10) Patent No.: US 8,001,695 B2
(45) Date of Patent: Aug. 23, 2011

(54) AXLE GUIDE ASSEMBLY FOR DRYWALL COATING BOX

(76) Inventor: Ron Watters, Faribault, MN (US)

( * ) Notice: Subject to any disclaimer, the term of this patent is extended or adjusted under 35 U.S.C. 154(b) by 662 days.

(21) Appl. No.: 12/083,486

(22) PCT Filed: Oct. 13, 2006

(86) PCT No.: PCT/US2006/039871

§ 371 (c)(1),
(2), (4) Date: Apr. 12, 2008

(87) PCT Pub. No.: WO2007/047355

PCT Pub. Date: Apr. 26, 2007

(65) Prior Publication Data

US 2009/0117284 A1 May 7, 2009

(51) Int. Cl.
*E04F 21/08* (2006.01)

(52) U.S. Cl. ..... 33/42; 401/48; 401/87

(58) Field of Classification Search ..... 33/42; 401/48, 401/87

See application file for complete search history.

(56) References Cited

U.S. PATENT DOCUMENTS

| | | | | | |
|---|---|---|---|---|---|
| 1,792,393 | A * | 2/1931 | Phillips | 33/42 |
| 1,830,860 | A * | 11/1931 | Scoles | 401/218 |
| 1,945,730 | A * | 2/1934 | Christman | 33/41.6 |
| 2,341,691 | A * | 2/1944 | Ciceske | 222/611.2 |
| 2,603,873 | A * | 7/1952 | Shaw | 33/42 |
| 2,824,442 | A * | 2/1958 | Ames | 425/87 |
| 3,520,628 | A * | 7/1970 | Moceri | 15/230.11 |
| 5,670,182 | A * | 9/1997 | Mower | 425/87 |
| 5,814,351 | A * | 9/1998 | Mower | 425/87 |
| 6,146,039 | A * | 11/2000 | Pool et al. | 401/48 |
| 6,739,790 | B1 * | 5/2004 | Crudele | 403/290 |
| 2010/0196078 | A1 * | 8/2010 | Ovens | 401/48 |

* cited by examiner

*Primary Examiner* — Christopher W Fulton
(74) *Attorney, Agent, or Firm* — Thomas B. Tate

(57) ABSTRACT

An axle guide assembly for a drywall coating box. The axle guide assembly comprises one or more, preferably two, axle guides. Each axle guide is a clip that fits onto an axle of a drywall coating box in order to allow coating mud to be applied to the outside of a corner bead. As the axle guide assembly is slid down the corner bead, mud is applied to the corner bead.

10 Claims, 2 Drawing Sheets

AXLE GUIDE ASSEMBLY FOR DRYWALL COATING BOX

BACKGROUND OF THE INVENTION

The field of the invention is drywall finishing tools, specifically, tools for applying coating mud compound to corner beads.

Drywall finishing is done using a system of taping with push tools. A flat coating box is used to finish joints between two pieces of drywall by applying a mud compound. The mud compound is filled into a slot in the front of the flat box using a hand pump. The person doing the drywall finishing applies the mud by pushing on a flap to which a handle is connected in order to push the mud out. The flat coating boxes come in three sizes (seven, ten, and twelve inches) because the first coat of mud applied is thinner, then the next coat is wider, different size boxes being used to apply each coat. For sideways motion or use on a ceiling, a pole is used in conjunction with the box, the pole being attached to the back flap by wing nuts.

A corner bead is a piece of metal or paper that fastens to the outside of two pieces of unfinished sheetrock. Corner beads pose a particular problem in drywall finishing. At present, the only mechanized way of finishing corner beads is a pneumatic taping system, for example, the system manufactured by Apla-Tech, Inc., Appleton, Wis., which uses "bead tabs". Pneumatic taping systems are expensive and therefore not widely used. Corner beads are usually finished by hand, which is a time-consuming and laborious process.

SUMMARY OF THE INVENTION

The invention is an axle guide assembly for a drywall flat coating box. Normally the axle guide assembly comprises two axle guides that are mounted onto the axle of a drywall coating box. Each of the two axle guides is a clip and washer assembly that attaches to a drywall coating box to allow a worker to coat the outside of a corner bead. The axle guide assembly slides down the corner bead, and as it gets pulled down, mud coats the corner bead.

An advantage of the invention is that corner beads can be coated two to four times faster than by hand.

Another advantage of the invention is that the axle guide assembly can be retrofitted onto any existing model of coating box (about seven different manufacturers make the boxes). The axle guide assembly can be permanently attached, and it does not hinder the original purpose of the coating box. Therefore the axle guide assembly does not need to be put on each time it is used or taken off between uses.

DETAILED DESCRIPTION OF THE INVENTION

Figure 1:
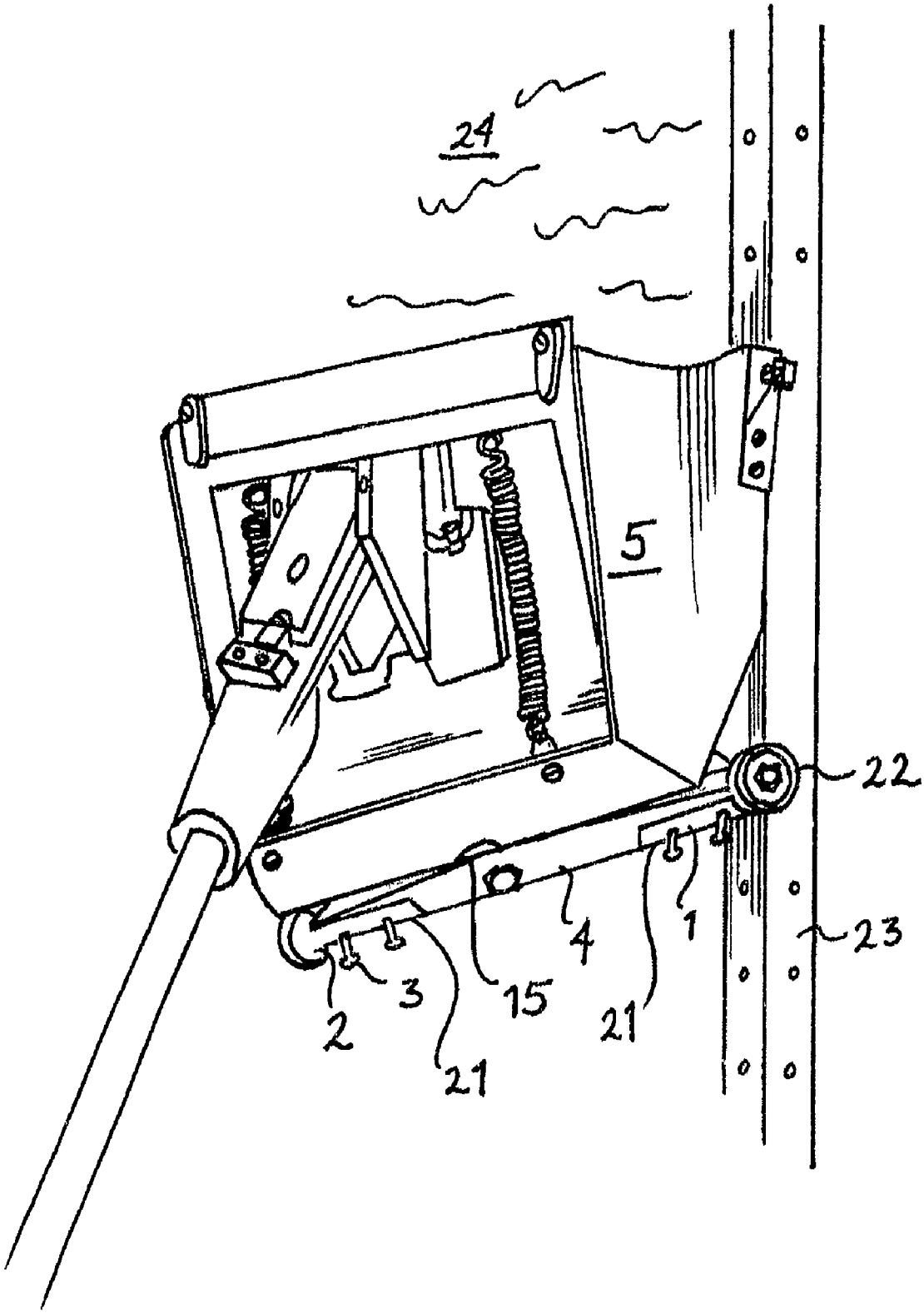
FIG. 1 is a perspective view of the back side of a drywall coating box with the axle guide assembly in position, showing how the invention is used to apply drywall mud compound to a corner bead.
Figure 2:
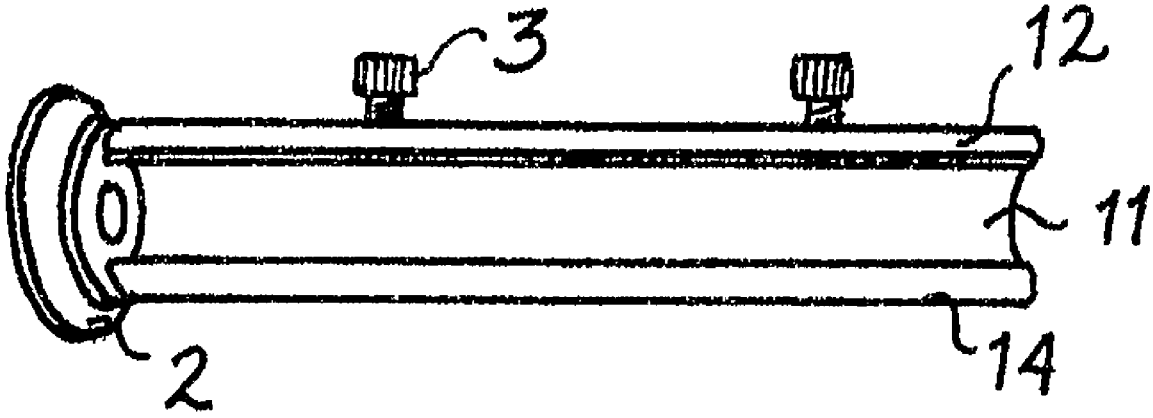
FIG. 2 is a back view of an axle guide.
Figure 3:
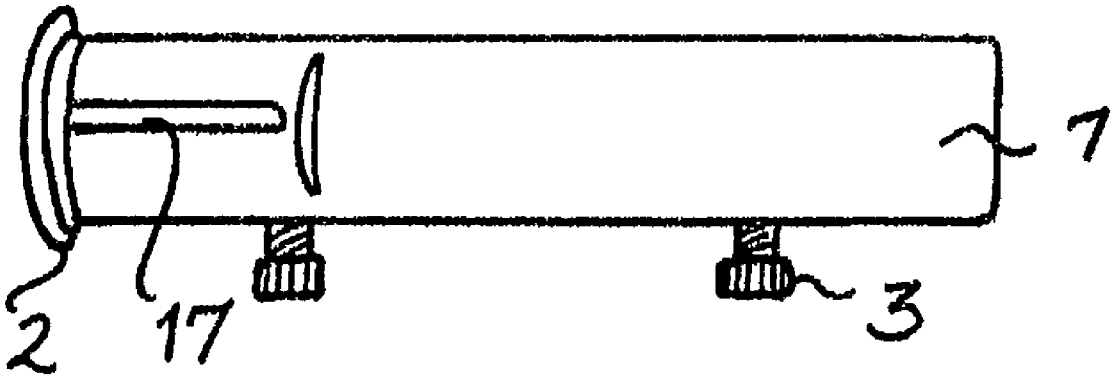
FIG. 3 is a front view of an axle guide.

The invention is an axle guide assembly comprising one or more axle guides. Each axle guide 21 comprises a clip 1 which is adapted to fit onto an axle 4 of a drywall coating box 5, a washer 2 which fits onto axle 4 at one end of clip 1, and screws 3 (preferably two of them) for securing clip 1 to axle

4. Preferably two axle guides 21 are fitted onto an axle 4 of a drywall coating box 5, one at each end.

The clip 1 is preferably made of plastic, but metal or other suitable materials could be used. The front side 7 of the clip 1 faces inward (toward the corner bead 23) when the guide is in position on the axle 4. One end of the front side 7 of the clip 1 is rounded, and preferably has a metal wear pin 17 disposed into a narrow groove. The rest of the front surface 7 is slightly recessed and is flat. The back side of the clip 1 is open, having a large groove 11 which is defined between top surface 12 and bottom surface 14, and which receives the axle 4 when in position. The screws 3 are disposed through openings in the top surface 12 of the clip 1, and contact the axle 4 when in position.

The washer (disc) 2 is preferably a shoulder washer, a type of washer that has a smaller diameter washer mounted on top of and formed integrally with a larger diameter washer. The shoulder washer 2 is preferably made of hardened tool steel, and bears the brunt of the wear when the axle guide 21 is in use. The washer 2 may be a separate washer or it may be an integral part of the clip 1. The guide washer 2 fits between the clip 1 and the standard washers 22 which are part of a drywall coating box 5 as it comes from the manufacturer. The washers 2 help guide the clips 1 down the corner bead, and the roundness of the guide washers 2 reduces friction as the axle guide 21 slides down the corner bead 23. A spacer washer 15 (preferably made of nylon) can be used in the narrow slit between the axle 4 and the flat box 5 to prevent the metal parts from catching on the corner bead 23.

To use the axle guide assembly, the drywall coating box 5 is filled with mud in the conventional manner; the drywall coating box 5 with the axle guide assembly in position thereon then slides over and down the corner bead 23, coating the corner bead 23 with mud 24 as the drywall coating box 5 with axle guide assembly thereon is pulled down the corner bead 23. The axle guide assembly is reversible so that it can be used for coating either horizontal or vertical corner beads.

Alternatively, it is possible to make the axle guide assembly as an integral part of a drywall coating box 5 by having the axle 4 formed into the shape of the clip 1 (which would also serve as the means for securing the clip 1 to the axle 4, making the screws 3 unnecessary), and in addition the guide washers 2 could be formed as an integral part of the axle 4.

The foregoing description of the preferred embodiment of the invention is offered as an illustration of the best mode for carrying out the invention, and not by way of limitation. It is intended that the scope of the invention include all equivalents that perform the same function in substantially the same way to achieve substantially the same result.

I claim:

1. An axle guide assembly for a drywall coating box, said axle guide assembly comprising one or more axle guides, each of said axle guides comprising:

clip means adapted to fit onto an axle of a drywall coating box;

washer means fitted onto said axle at one end of said clip means;

and means for securing said clip means to said axle.

2. The axle guide assembly of claim 1 wherein each of said clip means has a front surface which is rounded at one end and flat for the remainder of its length, a top surface, a bottom surface, and a groove defined between said top surface and said bottom surface.

3. The axle guide assembly of claim 1 wherein said washer means are shoulder washers.

4. The axle guide assembly of claim 1 wherein said means for securing said clip means are screws.

5. The axle guide assembly of claim 1 wherein said clip means and said means for securing said clip means to said axle comprise clip means formed integrally with said axle such that said axle is shaped in the form of said clip means.

6. The axle guide assembly of claim 1 wherein said washer means is formed integrally with said axle.

7. The axle guide assembly of claim 1 wherein said clip means, said washer means, and said means for securing said clip means to said axle are formed integrally with said axle.

8. The axle guide assembly of claim 1 wherein said axle guide assembly is additionally provided with space washer means, said space washer means being positioned between said axle and said drywall coating box.

9. The axle guide assembly of claim 1 wherein two of said axle guides are provided on said axle of said drywall coating box.

10. A method of applying drywall mud compound to a corner bead using the axle guide assembly of claim 1, said method comprising the following steps:

filling said drywall coating box with said mud compound in the conventional manner;

attaching said axle guide assembly to said drywall coating box if said axle guide assembly is not already permanently attached to or an integral part of said drywall coating box;

sliding said drywall coating box with said axle guide assembly in position thereon down said corner bead to coat said corner bead with said mud as said drywall coating box with said axle guide assembly thereon is pulled down said corner bead.

* * * * *